US006061987A

United States Patent [19]

King

[11] Patent Number: 6,061,987

[45] Date of Patent: May 16, 2000

[54] SHEET PANELS FOR EASY TO ASSEMBLE STRUCTURES

[75] Inventor: Robert E. King, San Diego, Calif.

[73] Assignee: Lemke Manufacturing, Inc., San Diego, Calif.

[21] Appl. No.: 09/066,546

[22] Filed: Apr. 24, 1998

Related U.S. Application Data

[60] Provisional application No. 60/044,796, Apr. 24, 1997.

[51] Int. Cl.[7] ..... E04C 2/00

[52] U.S. Cl. ..... 52/579; 52/589.1; 52/529; 52/536; 52/592.1; 52/92.2

[58] Field of Search ..... 52/579, 588.1, 52/589.1, 591.1, 527, 529, 536, 539, 592.1, 93.2, 92.2

[56] References Cited

U.S. PATENT DOCUMENTS

| | | | |
|---|---|---|---|
| 2,004,198 | 6/1935 | Fall | 52/536 |
| 2,152,189 | 3/1939 | Henderson | 52/579 X |
| 3,209,503 | 10/1965 | Mostoller | 52/529 X |
| 3,209,869 | 10/1965 | Hammitt | 52/592.1 X |
| 3,238,687 | 3/1966 | Tisbo | 52/539 X |
| 3,293,819 | 12/1966 | Heirich | 52/529 X |
| 3,394,524 | 7/1968 | Howarth | 52/529 X |
| 3,654,640 | 4/1972 | Katzman | 52/592.1 X |
| 3,742,672 | 7/1973 | Schaeufele . | |
| 3,952,461 | 4/1976 | Kinsey | 52/588.1 X |
| 4,004,392 | 1/1977 | Shepard et al. | 52/588.1 X |
| 4,538,391 | 9/1985 | Skrabis et al. | 52/529 X |
| 5,560,170 | 10/1996 | Ganser et al. | 52/539 |
| 5,581,968 | 12/1996 | Laurie et al. | 52/536 X |

*Primary Examiner*—Beth A. Aubrey
*Assistant Examiner*—Brian E. Glessner
*Attorney, Agent, or Firm*—Knobbe, Martens, Olson & Bear LLP

[57] ABSTRACT

A building side panel assembly, roof panel assembly, and roof beam are provided for modular construction wherein the panel assemblies may be inter-connected by an interlocking means which are located on each of the edges of the panel assemblies. The side panel assemblies are assembled in an edgewise relationship to form a structural barrier such as a wall. The panel assemblies are formed with a hemmed and a non-hemmed leg, wherein the non-hemmed leg of one panel assembly is configured to interlock with a hemmed leg of another panel assembly.

18 Claims, 13 Drawing Sheets

SHEET PANELS FOR EASY TO ASSEMBLE STRUCTURES

RELATED APPLICATIONS

This application claims the benefit of U.S. Provisional patent application entitled "Sheet Panels For Easy To Assemble Structures," filed on Apr. 24, 1997, application Ser. No. 60/044,796, and having attorney Docket Number LEMKE.001PR.

BACKGROUND OF THE INVENTION

1. Field of the Invention

The invention relates to construction materials. More particularly, the invention relates to interlocking building panels.

2. Description of the Related Art

Although more economical than custom or handmade structures, commercially available modular buildings leave much to be desired from the standpoint of cost, ease of assembly and reparability. One solution that has been tried by the building industry, is to manufacture walls which are formed of a large single integral fiberglass molded panel. However, these panels are bulky and cumbersome. Use of these large prefabricated panels increase handling, transportation, as well as, building costs. Further, a builder is limited to the size of the panel when determining the size of building which is to be constructed, or alternatively forced to manually cut the size of the paneling.

In the interest of keeping manufacturing costs low, prefabricated building manufacturers normally offer only a few building styles or models, i.e., a few combinations of a few different wall panels. Customization of a building for a particular appearance, use and/or weather conditions can increase manufacturing costs even if the customization is only moderate.

Apart from the disadvantages attendant in construction and assembly of prior art fabricated whole wall panel buildings, such buildings may prove difficult as well as expensive to repair. For example, severe damage to a portion to a wall may necessitate the replacement of the entire wall.

Although some have attempted to provide solutions, their success has been limited. For example, U.S. Pat. No. 3,742,672 to Schaufele, entitled "Modular Building Panel having Interlocking Edge Structure," discloses an interlocking panel structure. However, the Schaufele invention fails to satisfy several goals. First, in Schaufele the interlocking mechanism is not very secure. The interlocking panels of Schaufele are held together by tongue and socket connections. Although Schaufele teaches the use of additional fastening devices, these fastening devices increase the price of manufacturing. Further, Schaufele requires the use of a sealing element to provide a fluid-tight seal. However, the use of the sealing element increases the cost of manufacture of the building. Additionally, after the sealing element is applied, it is extremely difficult to disconnect the panels which may be needed if the building is to be dismantled or if one of the panels is in need of repair.

One additional problem that is associated with traditional building systems is that they require the use of a frame. Each additional building component that is needed to manufacture a building increases the total cost of construction.

SUMMARY OF THE INVENTION

The present invention is directed to panel assemblies and methods for the assembly of a variety of structures such as housing and lawn and garden structures having different shapes. One such structure includes a series of interlocking panel assemblies that can be assembled together in a relatively short time and with no additional hardware and few or no tools. The series of panel assemblies may be composed of any suitable metal. Moreover, these panel assemblies may be composed of any other material having suitable strength and resilience to withstand harsh variations in environmental conditions. The methods of assembly provide for easy assembly of these structures within hours or, in certain cases, minutes. These structures can be designed to aesthetically and environmentally conform with any desired community standard. The structures so erected are self-supporting and require no structural framework.

One aspect of the invention includes an interlocking building panel assembly comprising a central member, a non-hemmed support along a first edge of the central member; and a hemmed support along a second edge of the central member, wherein the hemmed end of the support is configured to receive a non-hemmed support of another interlocking building panel assembly.

BRIEF DESCRIPTION OF THE DRAWINGS

These and other advantages of the present invention are best understood with reference to the drawings, in which.

DETAILED DESCRIPTION OF THE INVENTION

The following detailed description is directed to certain specific embodiments of the invention. However, the invention can be embodied in a multitude of different ways as defined and covered by the claims. In this description, reference is made to the drawings wherein like parts are designated with like numerals throughout.

The present invention provides a set of panel assemblies and methods for the assembly of a variety of housing, lawn and garden structures having different shapes. The structures can be any of a variety of structures including, but not limited to, utility sheds, human or animal shelters, play houses, sun-roofs, patio and equipment covers, carports, fences, rose arbors, and many other structures. A typical structure comprises a series of interlocking panel assemblies that can be assembled together with virtually no additional hardware and few or no tools. The resultant structure is self-supporting without the need for an internal or external framework. The material and shape of the sheet panel assemblies can be customized to fit virtually any desired structure. The sheet panel assemblies can be composed of any material capable of withstanding changes in environmental conditions such as temperature extremes, rain or snow storms, and wind forces. The sheet panel assemblies can be made of aluminum alloys (e.g. 3003, 5052, or 6062), steel (galvanized, or stainless), plastics, and other similar material. The sheet panel assemblies may be treated and/or painted to achieve any desirable appearance. In addition, the final structure can be fitted with suitable insulating material to cope with environmental demands.

In one embodiment of the present invention, there are at least two panel assembly configurations: (1) a side and roof panel assembly and (2) a corner panel assembly. Optionally, the ends of the roof panel assemblies may be designed so that the ends of the side panel assemblies are configured differently than the ends of the roof panel assemblies. The various types of end configurations for the panel assemblies of the invention will be discussed in greater detail below.

Figure 1:
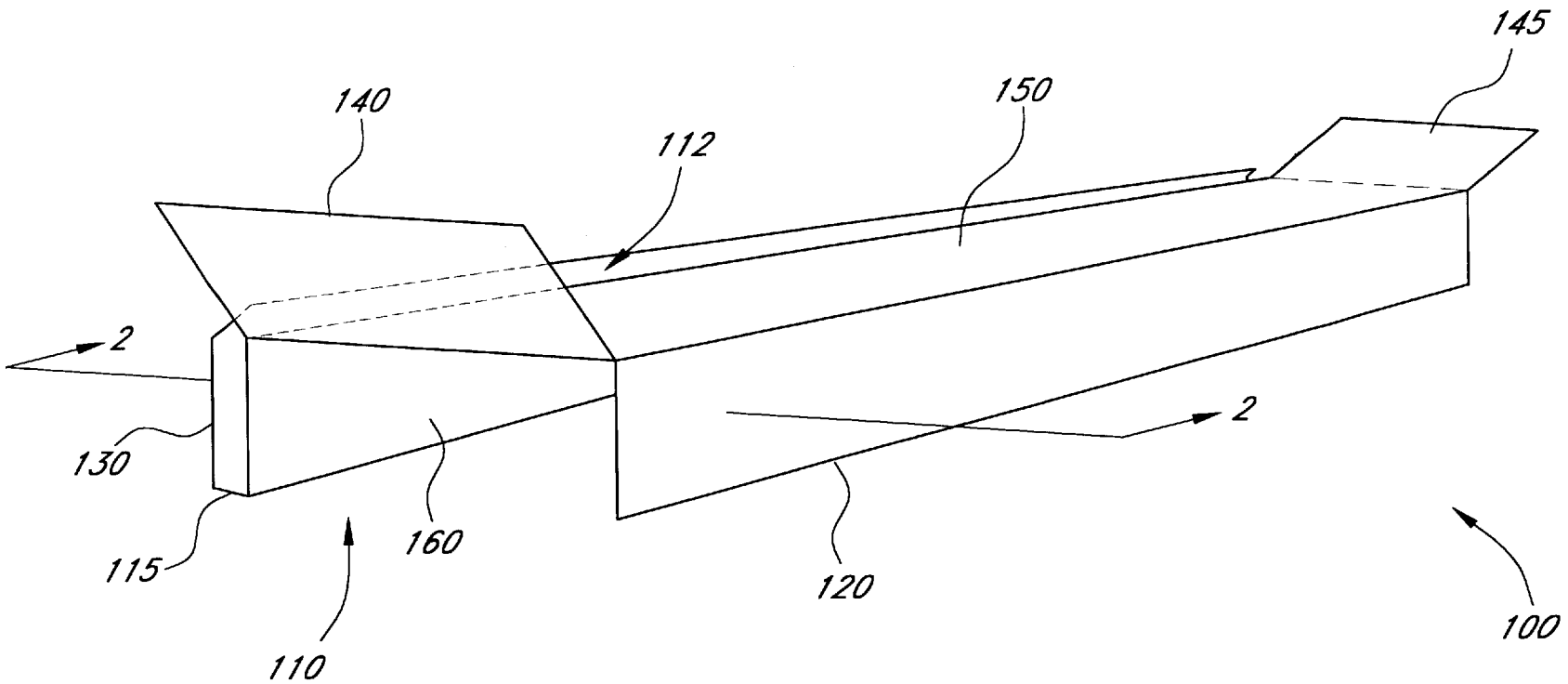
FIG. 1 is a perspective view of an exemplary side panel assembly used in assembling the desired structure.

FIG. 1 is a perspective view of a panel assembly 100 suitable for assembling a structure such as a utility shed. The panel assembly 100 is generally u-shaped in cross section and is particularly suited for use as a side panel of a structure. The panel 100 has a hemmed leg 110, a non-hemmed leg 120, a first and second end tab 140 and 145, and a central member 150.

The non-hemmed leg 120 extends perpendicularly along one edge of the central member 150. The hemmed leg 110 extends along the opposite edge of the central member 150. The hemmed leg 110 includes three sections: a folded support 130, a side wall 160, and a bottom support 115. The side wall 130 extends perpendicularly from the edge of the central member 150. The bottom support 115 extends from the bottom of the side wall 160 and joins the support 130 to the side wall 160.

In an exemplary configuration, the panel assembly 100 is erected vertically whereby it is interlocked with a second similarly constructed panel assembly by inserting a non-hemmed leg (similar to the non-hemmed leg 120) of the second panel assembly (not shown in this figure) into the hemmed leg 110 of the side panel assembly 100. The hemmed leg 110 and the non-hemmed leg 120 act as structural supports for the panel assembly 100 by providing rigidity to the panel assembly.

The end tabs 140, 145, as described below, extend from a third and fourth edge of the central member 150, respectively. The length of the first and second end tab, 140, 145 can be several inches, and in one embodiment is 3 inches long. The length of the side panel assembly 100 can vary up to several feet depending on the desired structure. The hemmed leg 110 and the non-hemmed leg 120 may be configured into a variety of interlocking shapes.

Figure 2:
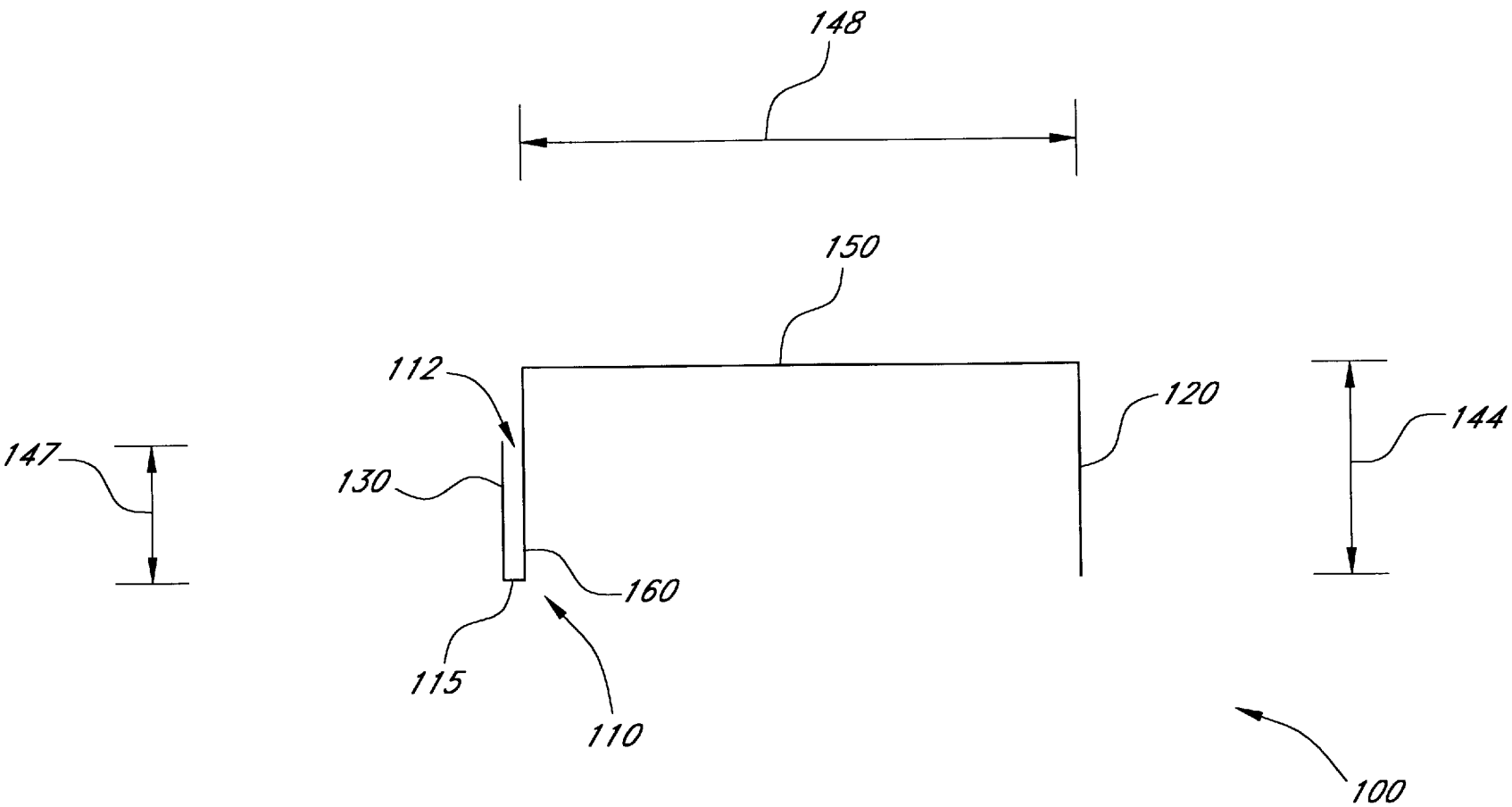
FIG. 2 is a cross sectional view of the side panel assembly of FIG. 1 taken along lines 2—2.

FIG. 2 is a cross-sectional view of the side panel assembly 100 of FIG. 1. The width 148 of the central member 150 can be several inches and, in one embodiment, is 6 inches wide. The height 144 of the non-hemmed leg 120 can be several inches, and in one embodiment is 1.5 inches long. The height of the hemmed leg 110 can be several inches, and in one embodiment is equal to the height 144 of the non-hemmed leg 120. The height 147 of the folded support 130 can be several inches, and in one embodiment is 1 inch long. The width of the space 115 separating the hemmed leg 110 and the folded support 130 depends on the thickness of the material used, and may be approximately 0.05 inches wide. The length of the side panel assembly 100 (see FIG. 1) can be several feet and will depend the desired shape of the structure.

Figure 3:
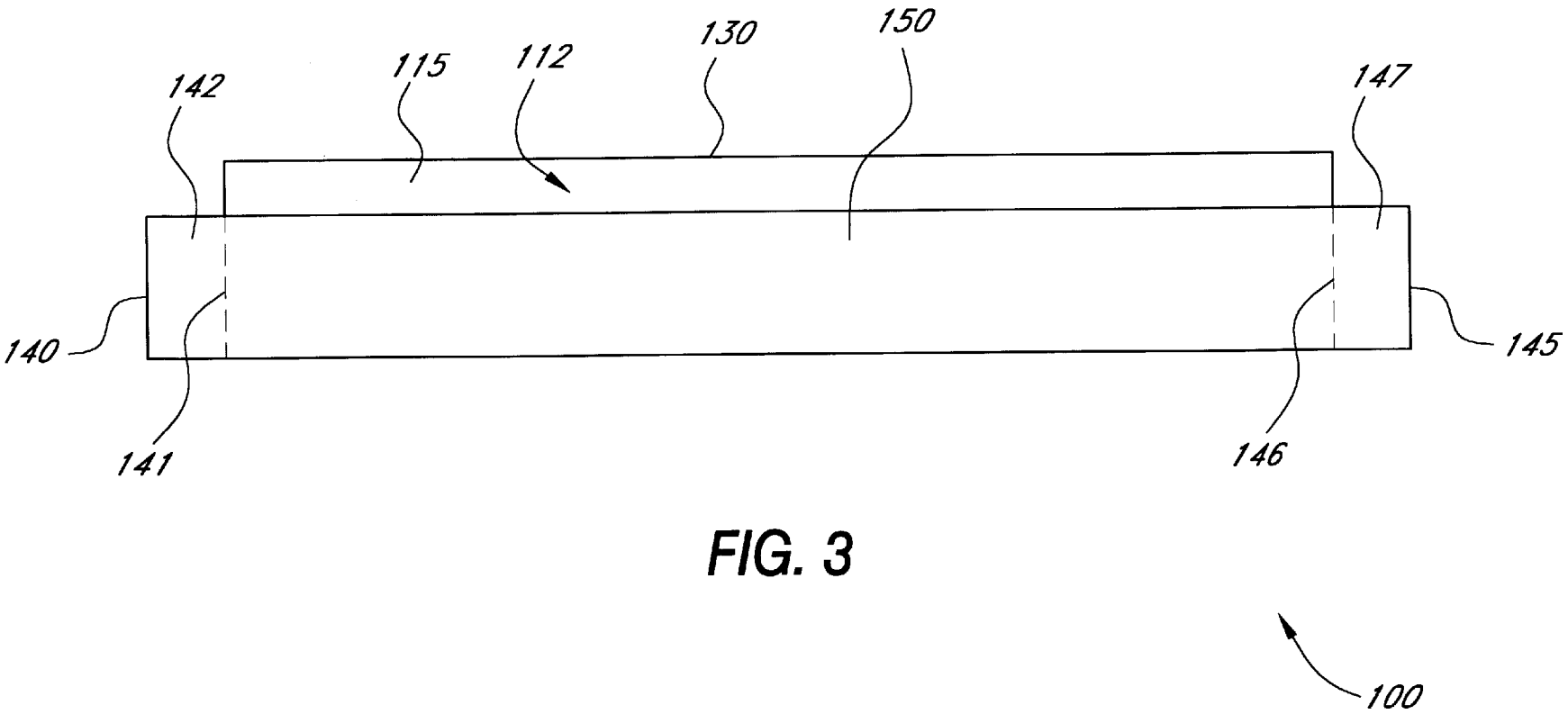
FIG. 3 is a top plan view of an exemplary side panel assembly used in assembling the desired structure.

FIG. 3 is a top plan view of the side panel assembly 100. As is shown in FIG. 3, the side panel assembly 100 includes the first and second end tabs 140 and 145, respectively. The first and second end tabs 140 and 145 are designed to be folded or bent for connection with other portions of the desired structure, e.g., a roof portion of the structure. The first end tab 140 is designed to bend at a score 141, whereas the second end tab 145 is designed to bend at a score 146. Alternatively, the end tab 145 may be configured according to the interlock shown in FIGS. 7 and 8 and described below.

It is to be noted, that no tools or equipment are required to assemble the desired structure. Because the panel assemblies are configured in the shape of a channel, the legs of the channels act as supports and take the place of the (otherwise needed) structural frame for these structures. The placement of the legs of each panel assembly every six or so inches along the structure walls and roofs eliminate the need for internal or external framework.

Figure 4:
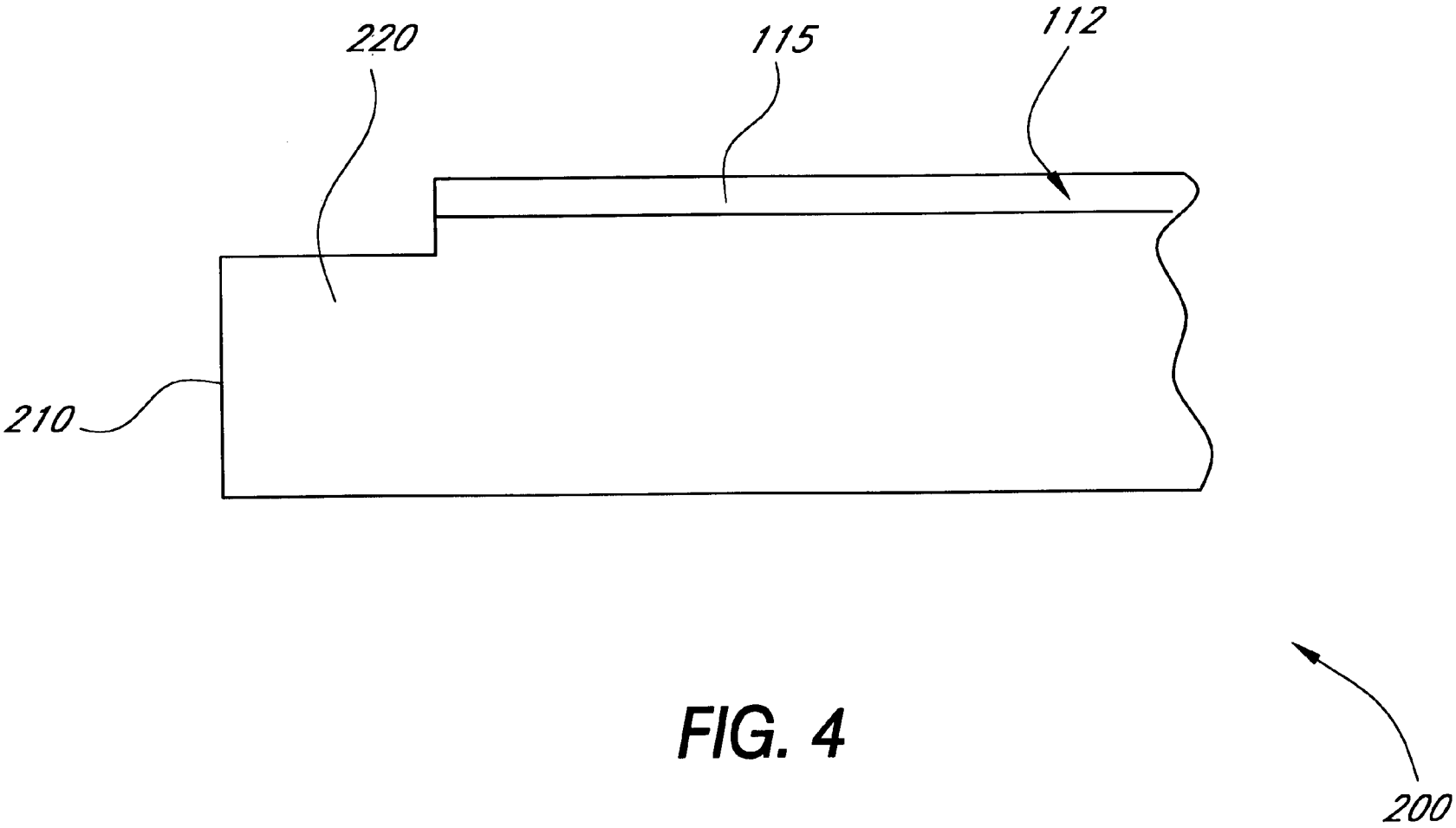
FIG. 4 is a top plan view of an exemplary roof panel assembly used in assembling the desired structure.
Figure 9:
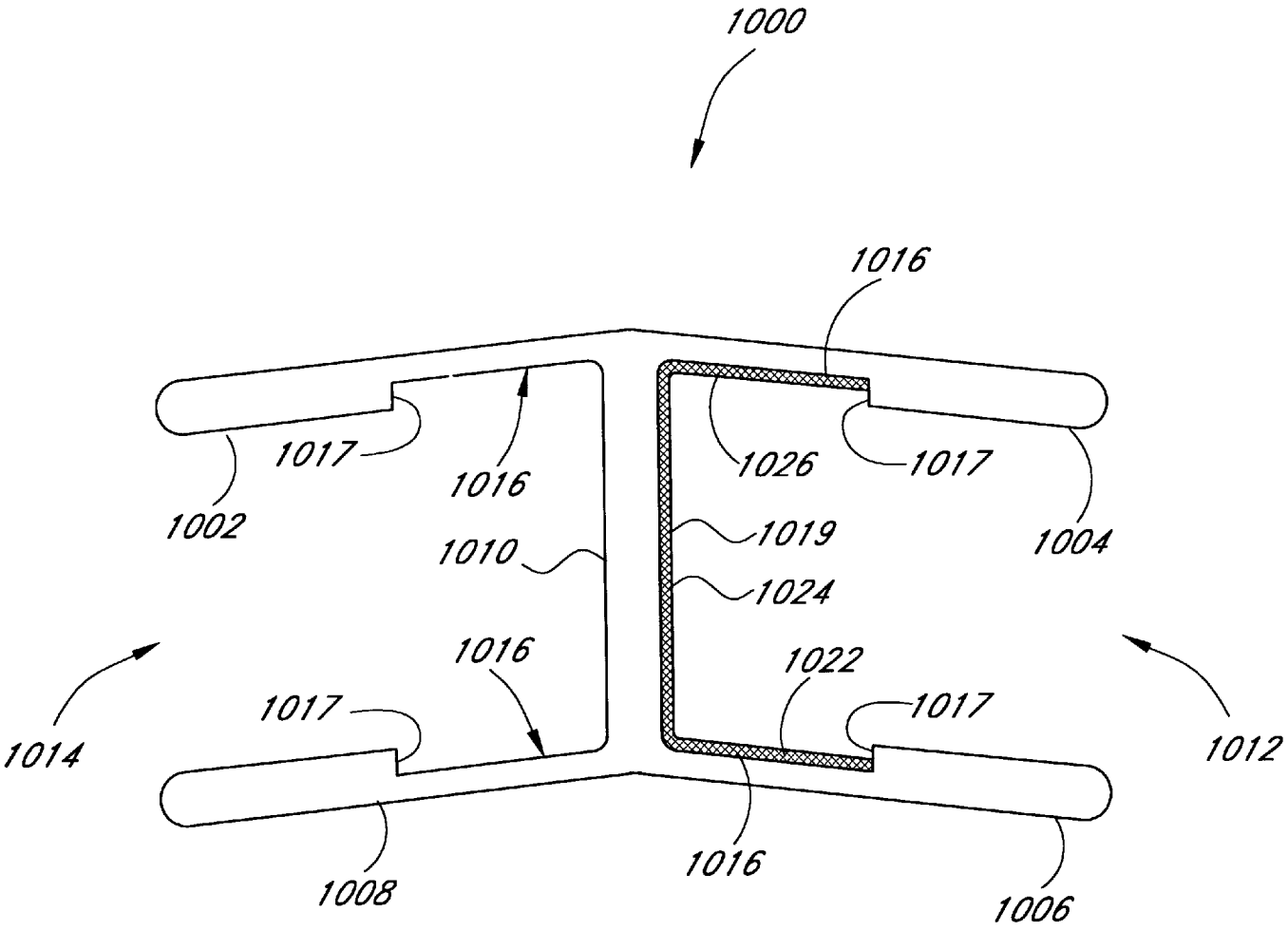
FIG. 9 is a side elevational view of a roof peak beam.
Figure 10:
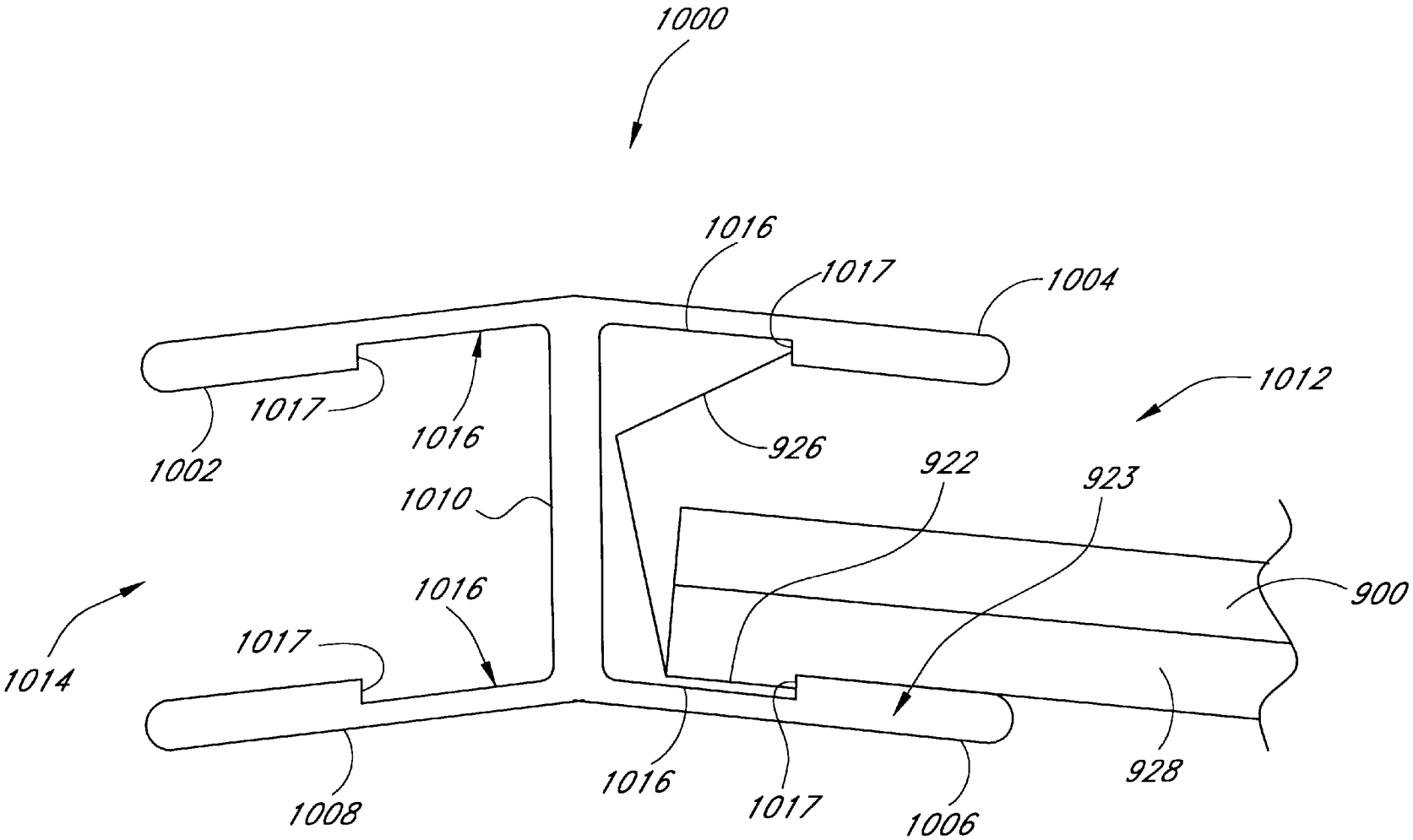
FIG. 10 is a side elevational view of a roof peak beam connected to the panel assembly of FIG. 7.

FIG. 4 is a top plan view of a panel assembly 200 particularly suited for use as a roof panel. The panel assembly 200 is similar in design and characteristics to the above-described (side) panel assembly 100, except for the differences noted. As described above, the side panel assembly 100 is often used in a vertical configuration to form a wall or similar portion of a structure. While similar in shape to the side panel assembly 100, the roof panel assembly 200 has two end tabs (only one end tab 210 shown in this figure) which may be bent forming different angles with the plane of the roof panel assembly 200. Moreover, the end tab 210 can be interlocked with the second end tab 145 of the side panel assembly 100. Alternatively, the end tabs of each of the panel assemblies may be configured as shown in FIGS. 9 and 10 and discussed below.

Figure 5B:
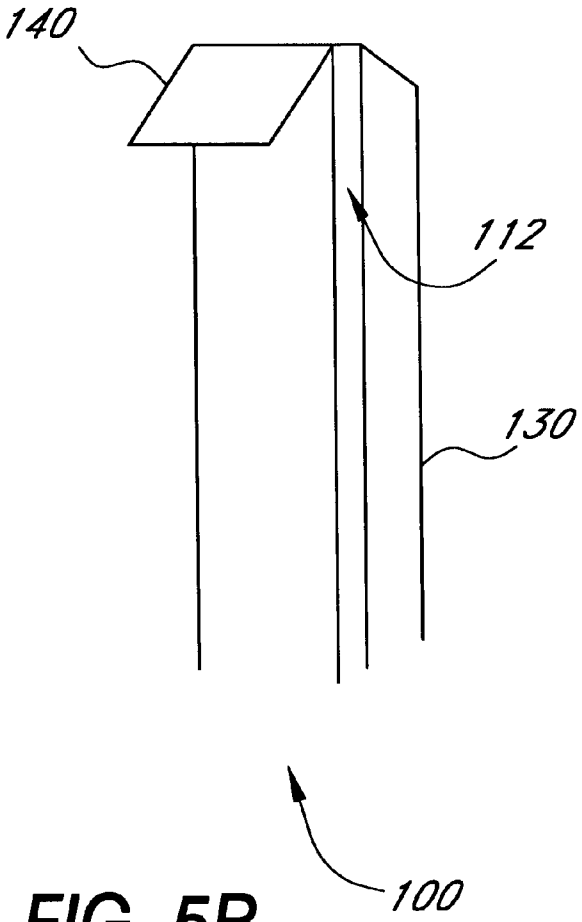
FIG. 5 is a perspective view of the roof panel assembly of FIG. 4 and the side panel assembly of FIG. 1 configured for mating together.
Figure 5A:
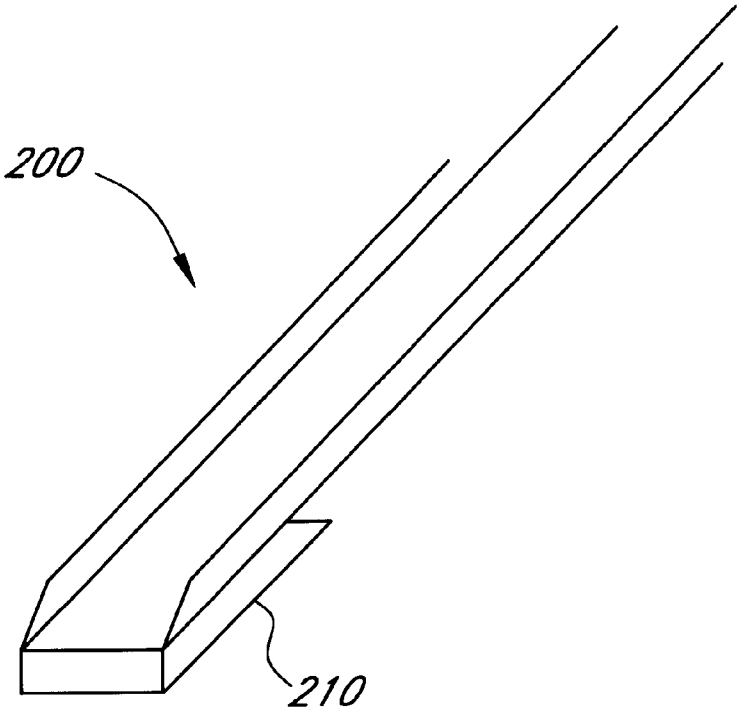

FIG. 5 is an exemplary view of a side panel assembly 100 and a roof panel assembly 200 configured for interlocking together. A side panel assembly 100 having an end tab 140 and a roof panel assembly 200 having an end tab 210 are shown to illustrate their integration to form the desired structure. The end tab 140 is bent at an angle of 90°+ pitch angle of the roof or preferably around 96° from the plane of the central member 150 (where the pitch of the roof is 6°). Of course, alternative angles can be used depending on the specific application. The end tab 210 is bent to be parallel with the plane of the member of the roof panel assembly 200. These angles are later adjusted to allow the insertion of the end tab 140 between end tab 210 and its roof panel assembly 200. In one embodiment of the invention, the tabs 140, 210 are crimped together via a crimping tool or otherwise second to each other to enhance the rigidity of the resulting structure.

Figure 6:
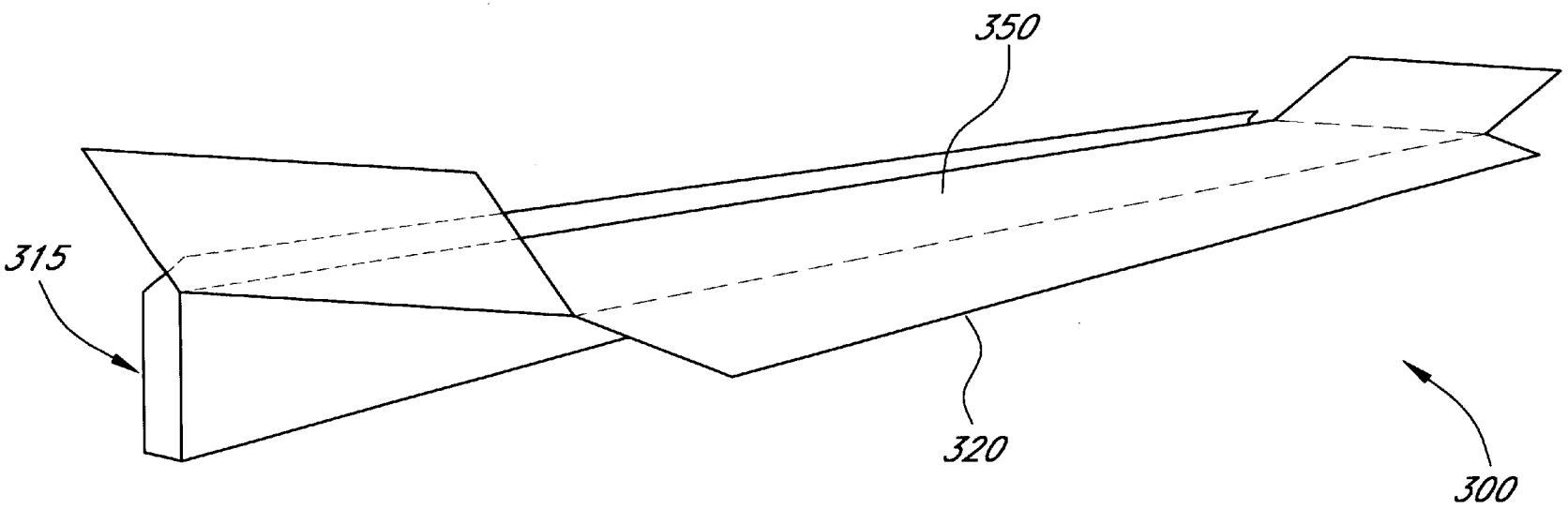
FIG. 6 is a perspective view of an exemplary corner panel assembly used in assembling the desired structure.

FIG. 6 is a view of a panel assembly 300 particularly suited for use at the corners of a structure. The corner panel assembly 300 is similar in design and characteristics to the above-described side panel assembly 100, except for the noted differences. The corner panel assembly 300 is distinguished from the side panel assembly 100 by its non-hemmed leg 320 which extends on the same plane as the central member 350. The modification in the layout of the non-hemmed leg 320 accommodates for a ninety-degree corner to be formed when assembling the desired structure. It is to be appreciated that the non-hemmed leg 320 may join the surface 350 of the corner panel assembly at various angles to provide for the construction of other than rectangular structures.

Figure 7:
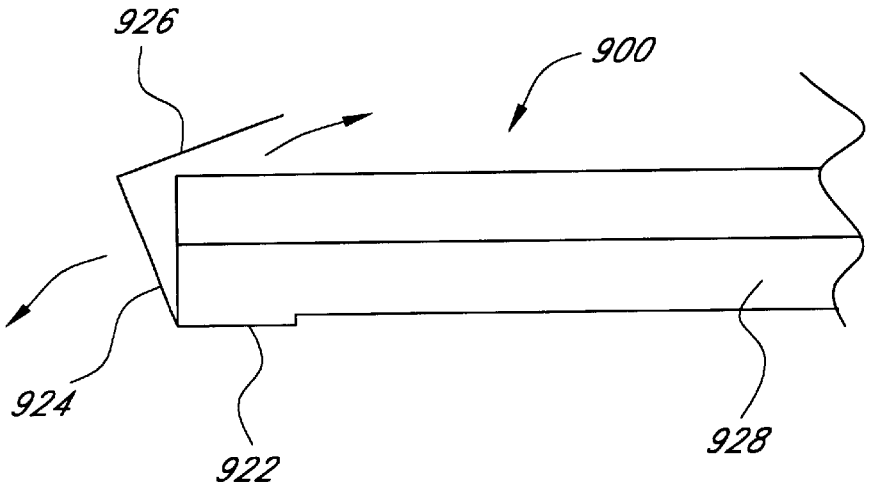
FIG. 7 is a partial side elevational view of a panel assembly depicting an end tab bent to a configuration that will lock into a roof peak beam, a floor connector or a roof connector.
Figure 8:
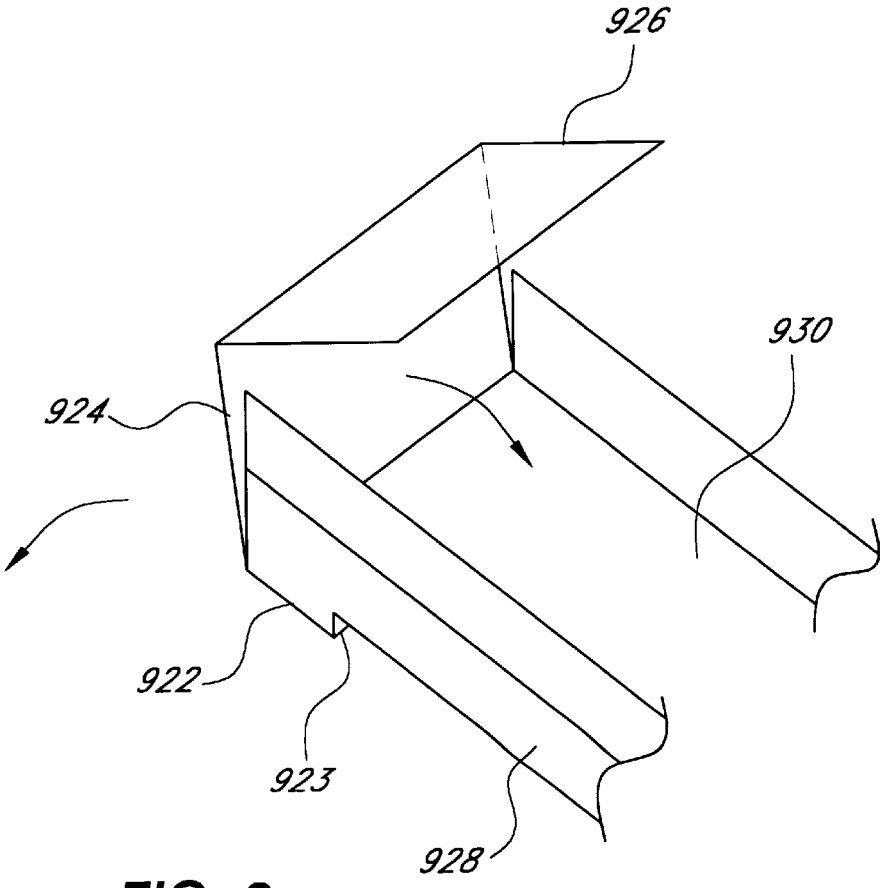
FIG. 8 is a partial perspective view of the panel assembly of FIG. 7.

Referring now to FIGS. 7 and 8, an alternative end configuration of a side and roof panel assembly is disclosed. FIG. 7 is a partial side elevational view, and FIG. 8 is a perspective view of one end of a panel assembly 900. The panel assembly 900 has an end tab comprising a lower and upper catching arms 924 and 926, respectively. The lower and upper catching arms 924 and 926 are configured to engage and lock in a peak roof beam 1000 shown in FIG. 9. Similar to the side panel assembly 100, the panel assembly 900 has a hemmed leg 928 and a non-hemmed leg (not shown) which form a channel 930 therebetween. The lower catching arm 924 extends from the bottom of an extension 922 which is located on the bottom of the panel assembly 900. Further, a stop surface 923 extends along the end of the extension 922 which is opposite to the lower catching arm 924. The stop surface 923 defines half of a catching mechanism for when the panel assembly 900 is integrated with a connector such as is shown in FIG. 9. Moreover, the upper catching arm 926 is flexible enough to move toward or away from the channel 930 to facilitate the integration of the end panel assembly 900 with a connector such as is shown in FIG. 9 and discussed below.

FIG. 9 is a side elevational view of a roof peak beam 1000 with a beam coupler 1019. The roof peak beam 1000 is particularly suited for use as a central connecting beam located at the apex of a roof. However, it is to be appreciated that the roof peak beam may be used in other locations. The roof peak beam 1000, which is roughly shaped as an I-beam, includes four connector strips 1002, 1004, 1006, and 1008 extending from a main section 1010. The connector strips 1002 and 1008 define a first opening 1014 for one set of roof panel assemblies, and the connector strips 1004, 1006 provide a second opening 1012 for a second set of roof panel assemblies. Further, the connector strips 1002, 1004, 1006, and 1008 each have a first recess region 1016 which is located next to the main section 1010. The recess region 1016 of the connector strip 1002 runs parallel to the recess region 1016 of the connector strip 1008. Similarly, the recess region 1016 of the connector strip 1004 runs parallel to the recess region 1016 of the connector strip 1006. Further, each of the connector strips 1002, 1004, 1006, 1008 has a catching lip 1017 which is located along the edge of the recess region 1016 opposite the main section 1010. The catching lip 1017 is connected to the recess region 1016 at approximately a 90 degree angle. The recess region 1016 and the catching lip 1017 are used in securing the end of a panel assembly, such as the panel assembly 900 of FIGS. 7 and 8.

FIG. 10 illustrates a panel assembly 900 of FIGS. 7 and 8 that is connected to the roof peak beam 1000 of FIG. 9. It is noted, the process for integrating the panel assembly 900 with the roof peak beam 1000 is readily accomplished by inserting the end of the panel assembly into the opening 1012 of the roof peak beam 1000. When the catching arm 926 of the panel assembly 900 first comes into contact with the connector strip 1004, the catching arm 926 is compressed by the connector toward the channel 930 of FIG. 8. After the panel assembly 900 is pressed further into the opening 1012, the catching arm 926 springs up into the space provided by the recess region 1016 of the connector strip 1004 rests in the corner formed by the catching lip 1017 and the recess region 1016 of the connecting strip 1004. Further, the extension 922 may rest in the recess region 1016 of the connector strip 1006 with the stop surface 923 abutting the catching lip 1017 of the connector strip 1008 with the catching lip 1017 forming the second half of the catching mechanism mentioned above with regard to stop surface 923 shown in FIG. 7.

Figure 11:
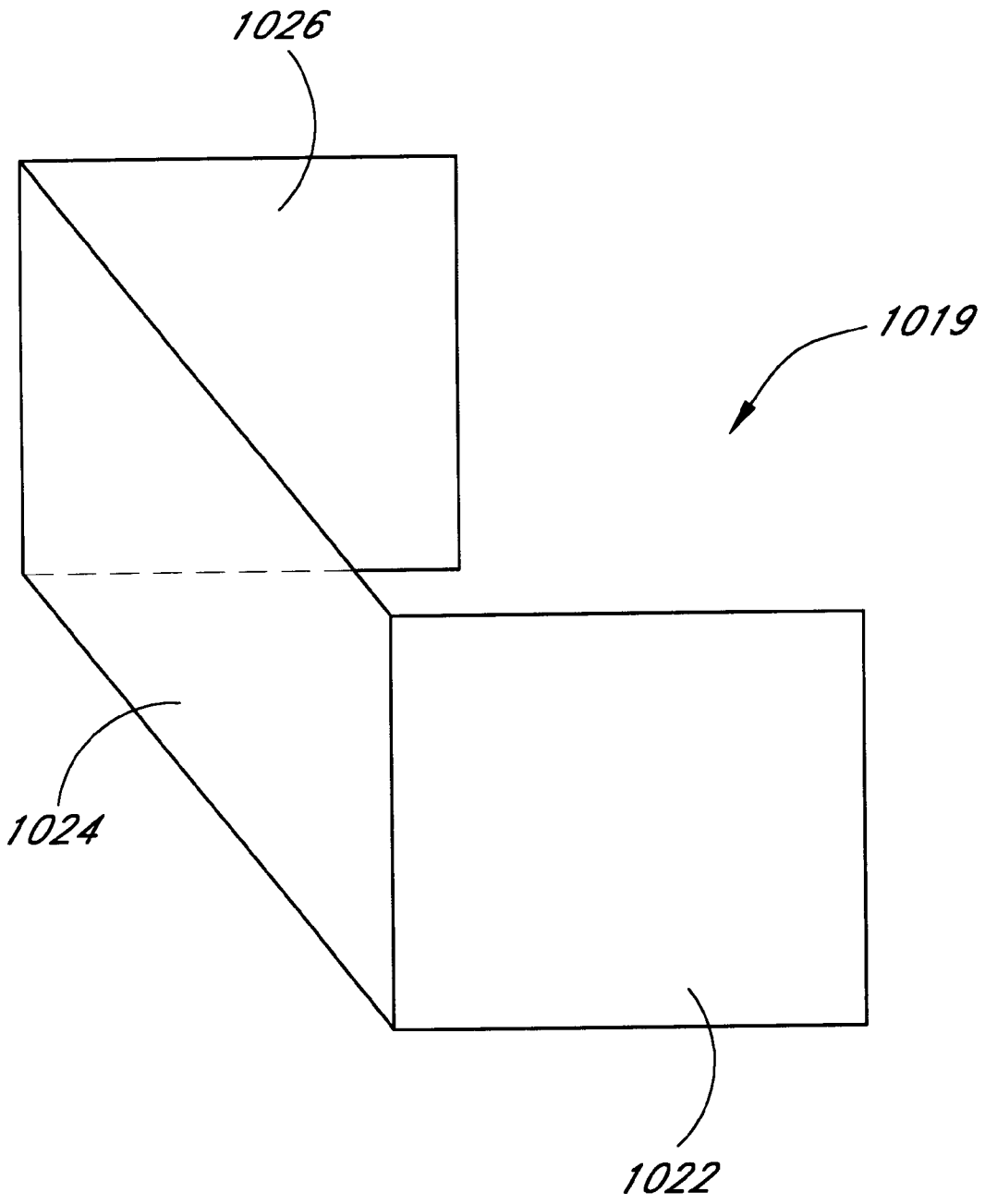
FIG. 11 is a perspective view of a roof extension panel assembly, which may be used to join two roof peak beams, such as is shown in FIG. 9.

Referring to FIG. 11, the beam coupler 1019 is shown in further detail. The beam coupler 1019 has a first, second, and third planar sections 1022, 1024, and 1026. The second planar section 1024 extends at a 90 degree angle at a first edge of the first planar section 1022. The third planar section 1026 extends at a 90 degree angle to a second end of the second planar surface 1024. Of course, the angles can be varied depending upon the particular application. The beam coupler 1019 is formed to fit within the opening 1012 and 1014 of the roof peak beam 1000 as shown in FIG. 9. The beam coupler 1019 may be used to join two roof peak beams together by inserting the beam coupler 1019 into two roof peak beams thereby joining the beams together.

Figure 12:
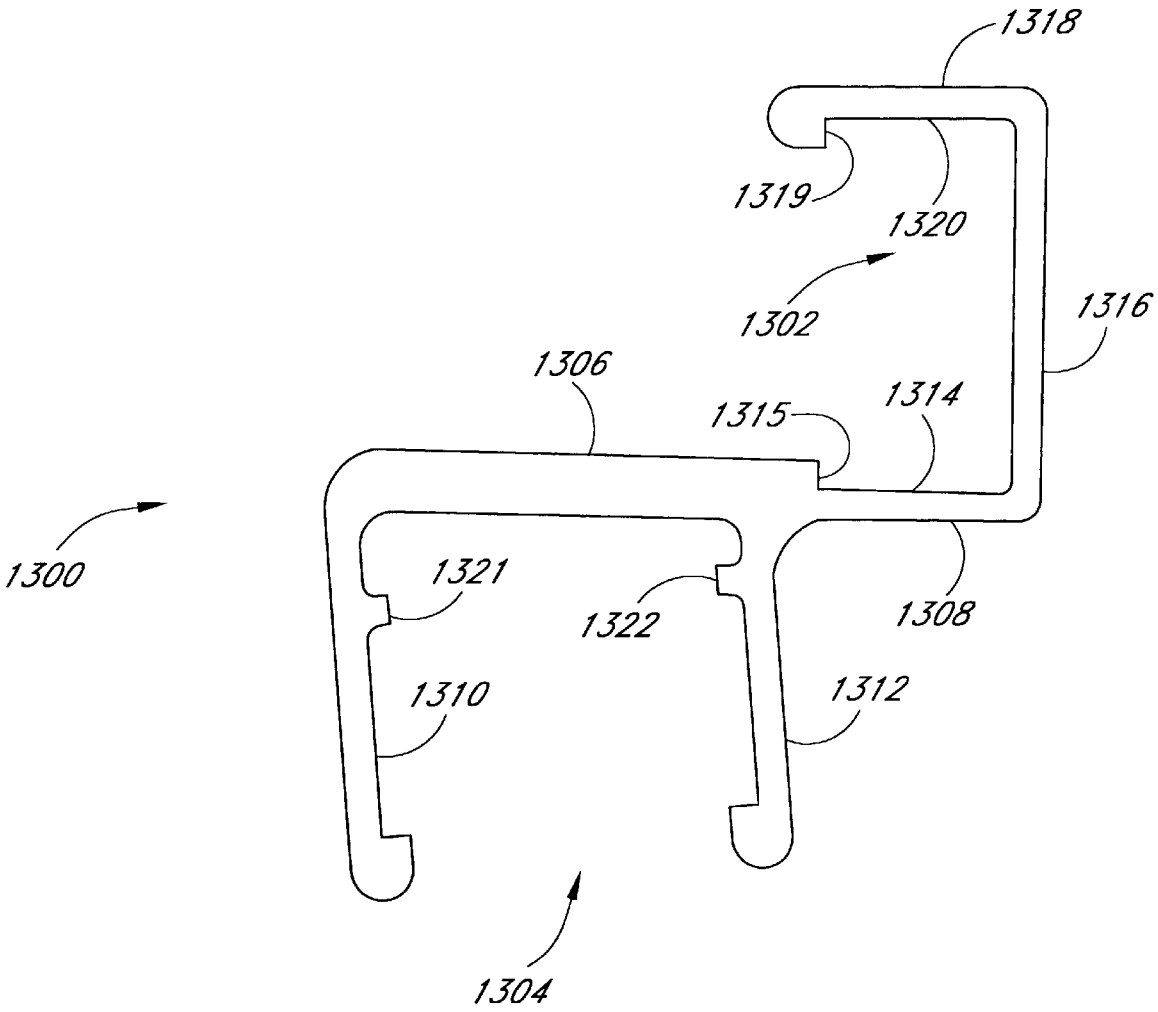
FIG. 12 is a side elevational view of a roof connector which may be used to connect multiple panel assemblies which are similarly designed to the panel assembly of FIGS. 7 and 8.

FIG. 12 is a side elevational view of a roof panel connector 1300. The roof connector 1300 has two openings 1302, 1304 for the insertion of a side panel assembly and a roof panel assembly, respectively. The roof and side panel assembly may each be similarly designed as the panel assembly 900 shown in FIG. 7. The roof connector 1300 includes a main section 1306 having multiple appendages 1308, 1310, 1312. The main section 1306 for purpose of discussion may be said to lay on a roof plane. In one embodiment of the invention, the roof plane is elevated at an angle 6° from the plane of the ground, which can be said to constitute a ground plane. The first appendage 1308 extends from the main section 1306 in the direction of the roof plane. The first appendage 1308 is narrower than the main section 1306 so as to define a recess region 1314. The first appendage 1308 also has a catching lip 1315 extending at ninety degrees from the recess region 1314. At the end of the first appendage 1308 opposite to the connection with the main section 1306, a riser 1316 extends at 90 degrees from the roof plane. At a second end of the riser 1316, a roof end cover 1318 extends in the direction of the roof plane back toward the main section 1306. The roof end cover 1318 also defines a recess region 1322 facing the first appendage 1308. Further, the roof end cover 1318 has a catching lip 1319 extending along the recess region 1320, distal to the riser 1316. The first appendage 1308, the riser 1316, and the roof end cover 1318 define the opening 1302 for receiving one end of a roof panel assembly.

A second and third appendage 1310, 1312 each extend, respectively, from a first and second end of the main section 1300 toward the ground plane. The first and second appendage 1310, 1312 each have a protrusion 1321, 1322, respectively, which protrude in the direction of the other appendage 1310, 1312. The protrusions 1321, 1322, and the second and third appendages 1310, 1312 define the opening 1304 for an end configuration of a side panel assembly. Using the roof connector 1300, a roof panel assembly and a side panel assembly may be interconnected without using additional hardware. The locking mechanism of the roof connector 1300 operates similarly to the locking mechanism of the peak roof beam 1000 of FIGS. 9 and 10. For example, if one end of panel assembly 900 of FIG. 7 is inserted into the opening 1302, the upper catching arm 926 is deflected toward the main section 1300, until the upper catching arm 926 reaches the catching lip 1319. The upper catching arm 926 then slides across the face of the catching lip 1319 to rest in the corner formed by the juncture of the catching lip 1319 and the recess region 1320. Further, the extension 922 of the panel assembly 900 (FIG. 7) rests on the recess region 1314 of the first appendage 1308, and the stop surface 923 abuts the catching lip 1315.

Figure 13:
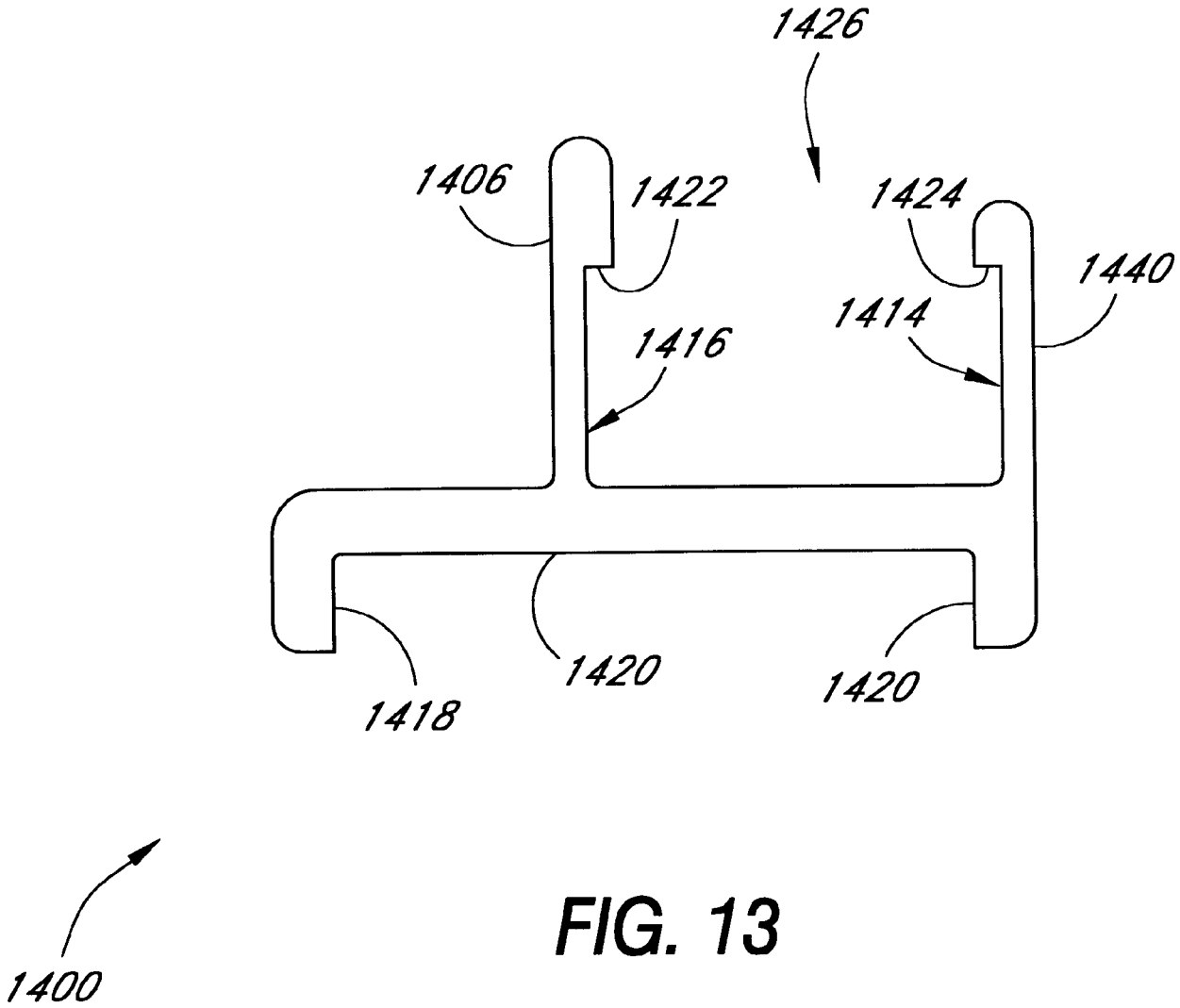
FIG. 13 is a side elevational view of a floor connector, which may be used to join the panel assembly of FIGS. 7 and 8 to a floor board.

Turning now to FIG. 13, a floor connector 1400 is illustrated. The floor connector 1400 includes a main section 1402 and four appendages 1404, 1406, 1418, 1420. The first and second appendages 1404, 1406 extend from a first surface of the main section 1402 and provide a receptacle 1426 for the lower end of a side panel assembly. The first appendage 1404 extends from a first end of the main section 1402 at a 90 degree angle to the main section 1402. The second appendage 1406 extends perpendicularly from the main section 1402 at, approximately, two thirds of the distance from the first to the second end of the main section 1402. The first and second appendages 1402, 1404 provide recess regions 1414, 1416 which may be used to receive the end of a panel assembly such as is disclosed in FIG. 7. Further, the first and second appendages 1404, 1406 of the floor connector 1400 provide two catching lips 1422, 1424 which extend from one end of the recess regions.

Third and fourth appendages 1418, 1420 extend perpendicularly from a second side of the main section 1402. The third and fourth appendages 1418, 1420 extend from the first and second ends of the main section, respectively. The third and fourth appendages 1418, 1420 together provide an opening for the insertion of a floor board (not shown). It is noted, that the main section 1402 may optionally have an aperture situated between the first and second side of the main section 1402 which is configured to receive a nail to further secure a side panel assembly to the floor panel assembly.

Figure 14:
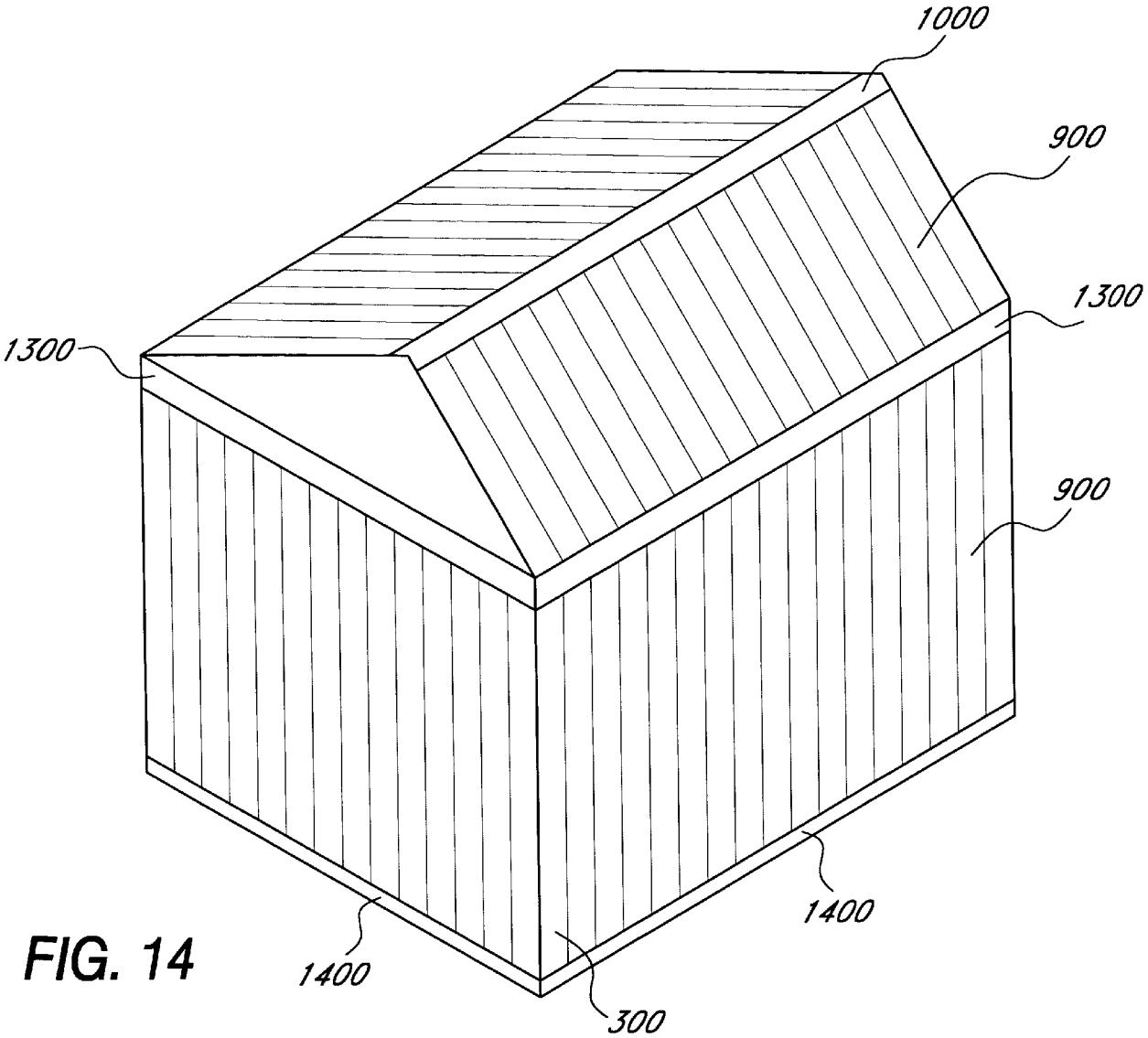
FIG. 14 is a perspective view of an exemplary structure assembled using one embodiment of the present invention.

FIG. 14 is a perspective view of an exemplary structure assembled using the foregoing elements. As illustrated in this figure, the panel assemblies 900 are interlocked with various roof connectors 1300, floor connectors 1400, and a roof peak beam 1000 to form the desired structure. Other sheet panel assemblies are configured by modifying the side panel assemblies and/or roof panel assemblies to fit in the desired shape of the final structure.

The roof and side panel assemblies of the invention overcomes several problems that associated with modular building systems. First, the paneling system of the invention provides a secure and watertight connection between each of the side panel assemblies. The tight interlock provided by the hemmed and non-hemmed supports of each of the panel assemblies prevents the penetration of rain and other liquids. Further, the paneling system of the invention provides easy to assemble building blocks for constructing structures without a frame. Moreover, the paneling system allows for the construction of the structure without extraneous bolts and fasteners. Since the structure may be constructed with a minimal amount of parts, construction costs for building the structure will be less than if the structure was built using traditional materials.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. The scope of the invention is indicated by the appended claims rather than by the foregoing description. All changes which come within the meaning and range of equivalency of the claims are to be embraced within their scope.

What is claimed is:

1. An interlocking panel assembly, comprising:

a central member having first and second edges, and first and second ends;

a non-hemmed support extending along said first edge of the central member;

a hemmed support connected to said second edge of the central member;

a lower catching arm extending outwardly at said first end of the central member; and an upper catching arm extending from the lower catching arm, wherein the upper catching arm extends inwardly from the lower catching arm toward the central member.

2. The interlocking panel assembly of claim 1, wherein the hemmed support includes a folded support, a side wall, and a bottom support, wherein the side wall at a first end extends approximately perpendicularly from a first end of the central member, the bottom support extends perpendicularly from a second end of the side wall, and the folded support extends from an end of the bottom support.

3. The interlocking building panel assembly of claim 1, wherein the panel assembly is formed from aluminum.

4. The panel assembly of claim 1, wherein the hemmed support includes a folded support, a side wall, and a bottom support, wherein the side wall extends approximately perpendicularly from the central member proximate to the second edge, the bottom support extends from the side wall opposite the central member, the folded support extends from the bottom support opposite the side wall, and the side wall, the bottom support and the folded support form a channel.

5. The panel assembly of claim 1, wherein the non-hemmed support extends from the central member at an angle of approximately ninety degrees to the central member.

6. The panel assembly of claim 1, wherein the hemmed support extends from the central member at an angle of approximately ninety degrees to the central member.

7. The panel assembly of claim 1, wherein the non-hemmed support extends upwardly from the central member, approximately perpendicular to the central member, wherein the hemmed support extends upwardly from the central member approximately perpendicular to the central member and wherein the lower catching arm extends upwardly from the central member, at an angle slightly less than perpendicular to the central member, and wherein the upper catching arm extends from the lower catching arm towards the second end of the central member.

8. The panel assembly of claim 1, wherein the central member further comprises an end tab extending from the central member proximate to the second end.

9. The panel assembly of claim 1, further comprising an extension proximate to the first end of the central member, the extension adapted to mate with a connector.

10. The panel assembly of claim 1, wherein the panel assembly does not include any apertures for fasteners.

11. A connector for connecting two panel assemblies comprising:

a main section having a first and second end;

a first appendage having a first and second end, wherein the first appendage extends from the main section at the first end, and wherein the first appendage comprises a first recess region and a first catching lip;

a first member having a first and second end, wherein the first end of the first member extends from the second end of the first appendage;

a second member extending from the second end of the first member, wherein the second member comprises a second recess and a second catching lip;

a second appendage extending from the first end of the main section; and a third appendage extending from the main section at the second end.

12. A connector for connecting a side panel assembly to a roof panel assembly, the connector comprising:

a main section having a first end, a second end opposite to the first end, a first surface, and a second surface opposite the first surface;

a first appendage extending from the main section proximate to the first end of the main section, the first appendage having a first end and second end forming a first recess region therebetween;

a riser which extends from the first appendage proximate to the second end of the first appendage;

a panel roof cover extending from the riser, having a second recess region which is opposed to the first recess region wherein the first appendage, the riser, and the panel roof cover form an opening adapted to receive a roof panel assembly;

a second appendage extending from the second surface of the main section, the second appendage comprising a catching lip which defines one end of a third recess region; and a third appendage extending from the second surface of the main section and having a fourth recess region which is opposed to the third recess region, the third appendage comprising a catching lip which defines one end of the fourth recess region, and wherein the second appendage, the third appendage and the main section form an opening adapted to receive a side panel assembly.

13. The connector of claim 12, wherein the first appendage extends from the first end of the main section in approximately the same plane which is formed by the first surface.

14. An interlocking panel system, comprising:

a panel assembly comprising:

a central member including a first edge, a second edge opposite to the first edge, a first end, and a second end opposite the first end;

a non-hemmed support extending from the central member proximate to the first edge;

a hemmed support extending from the central member proximate to the second edge; and a first end tab extending from the central member proximate to the first end, the first end tab comprising:

a lower catching arm extending outwardly from the first edge of the central member; and an upper catching arm extending from the lower catching arm, wherein the upper catching arm extends inwardly from the lower catching arm toward the central member; and a connector for connecting a panel assembly to a floor board, the connector comprising:

a main section including a first surface, a second surface opposite to the first surface, a first end, and a second end opposite to the first end;

a first appendage extending from the first surface of the main section proximate to the first end;

a second appendage extending from the first surface of the main section proximate to the second end, wherein the first and second appendage are configured to receive a floor board;

a third appendage having a recess region, wherein the third appendage extends from the second surface of the main section; and a fourth appendage having a recess region opposed to the recess region of the third appendage, wherein the fourth appendage extends from the second surface of the main section, and wherein the third and fourth appendages are configured to receive the first end tab of the panel assembly.

15. A method of connecting a panel assembly to a connector strip, the connector strip having an upper and a lower surface, the connector strip also having a recess region in the lower surface of the connector strip, the method comprising:

compressing a catching arm of a panel assembly against the lower surface of a connector strip;

sliding the catching arm of the panel assembly across the lower surface of the connector strip;

extending the catching arm into the recess region of the connector strip; and engaging the catching arm with a catching lip at an end of the recess region of the connector strip.

16. The method of claim 15, wherein the panel assembly is a side panel.

17. The method of claim 15, wherein the panel assembly is a roof panel.

18. An interlocking panel system, comprising:

a connector, comprising:

a first appendage having a first recessed region, and a second appendage having a second recessed region; and a panel assembly, comprising:

a central member, and an end tab, the end tab having at least one catching arm extending outwardly from the central member, the at least one tab adapted to mate with the first recessed region, wherein the at least one catching arm comprises a first catching arm extending outwardly from the central member connected to a second catching arm which extends inwardly toward the central member.

* * * * *